US006079333A

United States Patent [19]

Manning

[11] Patent Number: 6,079,333

[45] Date of Patent: Jun. 27, 2000

[54] GPS CONTROLLED BLASTER

[75] Inventor: Charles David Hope Manning, Christchurch, New Zealand

[73] Assignee: Trimble Navigation Limited, Sunnyvale, Calif.

[21] Appl. No.: 09/096,894

[22] Filed: Jun. 12, 1998

[51] Int. Cl.[7] ..... F23Q 7/02

[52] U.S. Cl. ..... 102/215; 102/200; 102/214; 102/332; 102/420

[58] Field of Search ..... 102/200, 207, 102/214, 215, 332, 420

[56] References Cited

U.S. PATENT DOCUMENTS

| | | | |
|---|---|---|---|
| 4,615,268 | 10/1986 | Nakano et al. | 102/200 |
| 4,757,764 | 7/1988 | Thureson et al. | 102/312 |
| 4,884,506 | 12/1989 | Guerrieri | 102/200 |
| 4,986,183 | 1/1991 | Jaccb et al. | 102/200 |
| 5,117,756 | 6/1992 | Goffin, II | 102/217 |
| 5,571,018 | 11/1996 | FitzGerald . | |
| 5,571,985 | 11/1996 | Ritter et al. | 102/217 |

*Primary Examiner*—Charles T. Jordan
*Assistant Examiner*—Dan Beitey
*Attorney, Agent, or Firm*—David R. Gildea

[57] ABSTRACT

A blasting system using the global positioning system (GPS) for timing the detonations for a shaped blast. The blasting system includes a master station including a master GPS receiver for determining a GPS-based time and a master transceiver in communication with several charge control stations. Each charge control station includes a charge control transceiver for communicating with the master transceiver, a charge control GPS receiver for tracking the GPS-based time, and a detonator for detonating an explosive charge. In operation, the master transceiver uses the GPS-based time determined at the master station for computing detonation times and transmits these times to the charge control stations. The charge control stations then detonate the respective explosive charges when the GPS-based times determined at the charge control stations match the detonation times. Location information determined by the charge control GPS receivers may be used by the master station for detecting errors in the placements of the explosive charges and for refining the detonation times.

12 Claims, 2 Drawing Sheets

GPS CONTROLLED BLASTER

BACKGROUND OF THE INVENTION

1. Field of the Invention

The invention relates generally to explosive blasting and more particularly to a system for using the global positioning system (GPS) for detonating shaped explosions.

2. Description of the Prior Art

In blasting operations, it is important to achieve the maximum breakage for a given amount of explosives in a blast. It is further important to minimize the effects of the blasting on nearby structures by reducing the amplitude of ground vibration produced by the blast. The principle method for achieving these objectives is to shape the blast by sequentially timing the detonation of a plurality of explosive charges placed at selected locations within an area of operation. The locations may be separated by several meters and may incorporate up to a thousand or even more explosive charges. An exemplary blasting system might require timing accuracies of a few tens of microseconds. Inaccuracies in the sequential timing or misplacement of any of the charges will degrade the accuracy of the shape of the blast. Similar issues are also important for seismic operations.

Traditionally a blasting system uses a web of electrical wires extending from a central node to detonators located with the explosive charges. The detonators may be triggered sequentially from the central node. However, because the electrical wiring web is likely to be destroyed before the sequence of triggers is completed, it is common to transmit an initial, common trigger to charge controllers that are located with the detonators where the charge controllers have selectable time delays for providing the sequential detonation times to the detonators. It is important to minimize the labor and material costs of the electrical wiring and the detonators because they are used only once and destroyed in the blast. Low cost charge controllers have for many years used short pyrotechnic trains of differing lengths having a fixed burn rate for providing the sequential times. However, this type of charge controller is not entirely satisfactory because the statistical variation in the fixed burn rate for different pyrotechnic trains limits the accuracy of the sequential times that can be achieved, thereby reducing the precision of the shape of the blast. In order to improve this accuracy, recent systems have used electronic time delay circuits in place of the pyrotechnic trains. The accuracy of such electronic time delay circuits depend upon the drift rate of an internal clock and the length of the delay time between the initial trigger and the detonation time. A simple electronic delay circuit can be constructed using a voltage controlled oscillator (VCO) as the internal clock. However, the accuracies of VCO clocks are typically not satisfactory unless they are stabilized. Such stabilization adds complexity and expense to the system. In order to improve the accuracy, crystal oscillator clocks have been used. Unfortunately, the accuracy of low cost crystal oscillators is insufficient for some applications. Further, in practice the use of oscillator clocks has not been entirely satisfactory for operation in harsh vibration environments such as those experienced in the blasting industry.

The routing of the electrical wire web from the central node to the charge controllers is laborious and error prone. Great care must be taken to inspect the wiring and test the connections. Also, the remains of the wires may need to be cleaned up after the blast so that the blasted material is not contaminated. In order to eliminate these problems, radio signal communication systems have been used for triggering the charger controllers. However, the requirement for a transceiver for transmitting and receiving the radio signals increases the cost of the charge controller. Further, the radio signals for such systems require a time consuming firing protocol. The protocol may use redundant signal transmissions and/or several retries to ensure that all the charge controllers have received the initial trigger and that a spurious signal cannot prevent the detonation of a particular explosive charge, or worse yet, cause the charge to be triggered unexpectedly. Unfortunately, the time for implementing the protocol increases the length of time over which the time delay circuits must maintain their accuracy, further increasing the cost of the charge controller. An exemplary protocol may require up to 1.5 seconds per charge control station. For 1000 explosive charges a total time of 1500 seconds would be required to verify that all the charge control stations were operational and in receipt of their detonation times. In order to obtain ten microseconds of detonation timing accuracy after 1500 seconds, the drift rate of the internal clock of the charge control station must be better than about $6.7\times10^{-9}$. Such drift rate is difficult to obtain without the use of an atomic clock.

There is a need for an inexpensive apparatus and a method for detonating a shaped blast without using an electrical wire web where the accuracy of the sequential timing of explosive charges is independent of the length of time for implementing a firing protocol.

SUMMARY OF THE INVENTION

It is therefore an object of the present invention to provide a blasting apparatus and method using the global positioning system (GPS) for timing the detonations for a shaped blast.

Briefly, in a preferred embodiment, the GPS blasting system of the present invention includes a master station including a master GPS receiver for determining a GPS-based time and a master transceiver in communication with at least one but typically many charge control stations. Each charge control station includes a charge control transceiver for communicating with the master transceiver, a charge control GPS receiver for computing the GPS-based time, and a detonator for detonating an explosive charge. As a part of the preparation for the blast, a respective sequential time and location is determined for each explosive charge. In operation, the master transceiver uses the GPS-based time for determining a reference time for some time in the future and then uses the reference time and the sequential times for determining and communicating respective detonation times to the charge control stations. The communication signals between the master station and the charge control station include an error checking protocol to ensure that each charge control station is operational. Each charge control station detonates its explosive charge when the GPS-based time determined by that charge control station reaches its detonation time. Optionally, the charge control stations communicate their locations to the master station for determining that the charge control stations are placed in the correct locations and/or for fine tuning the sequential times based upon their actual locations.

An advantage of the present invention is that a blast having an accurate shape may be triggered from GPS-based times having an accuracy that is independent of a length of time required for a radio signal protocol.

These and other objects and advantages of the present invention will no doubt become obvious to those of ordinary skill in the art after having read the following detailed description of the preferred embodiments which are illustrated in the various figures.

DETAILED DESCRIPTION OF THE PREFERRED EMBODIMENTS

Figure 1:
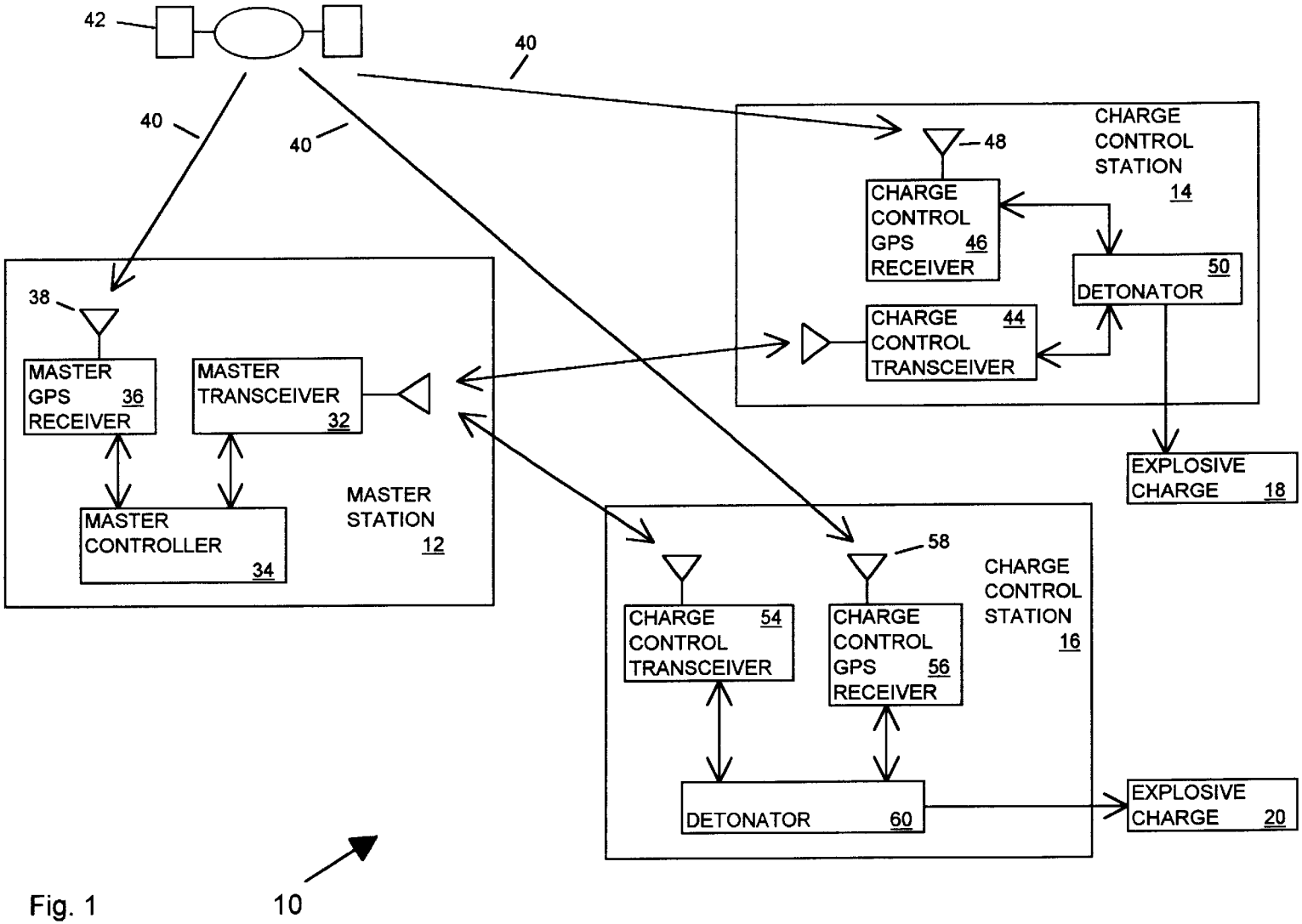
FIG. 1 is a block diagram of a blasting system of the present invention.

FIG. 1 is a block diagram of a blasting system of the present invention referred to by the general reference number 10 for creating a shaped blast. Such shaped blasts are important for seismic, demolation, and mining operations. The blasting system 10 includes a master station 12 and at least one but typically many charge control stations represented by charge control stations 14 and 16. Each of the charge control stations 14 and 16 is located with and connected to a respective explosive charge 18 and 20.

The master station 12 includes a master transceiver 32 for establishing communication and transmitting respective detonation times to the charge control stations 14 and 16, a master controller 34 including a microcontroller subsystem and a user interface for enabling a user to control the system 10, and a master global positioning system (GPS) receiver 36. The master GPS receiver 36 includes a GPS antenna 38 for receiving a GPS signal 40 that is continuously broadcast from several GPS satellites and/or GPS pseudolites represented by a GPS satellite 42. The pseudolites may be constructed using terrestrial stations for broadcasting the GPS signal 40 as if they were a GPS satellite. The master GPS receiver 36 processes the GPS signal 40 from at least one but preferably several GPS satellites 42 for determining a GPS-based time at the master station 12 that is used for calculating the detonation times. The charge control station 14 includes a charge control transceiver 44 for communicating with the master station 12 and receiving a first detonation time, a charge control GPS receiver 46 including a GPS antenna 48 for receiving the GPS signal 40 and determining a GPS-based time at the charge control station 14, and a detonator 50 for detonating the explosive charge 18 when the GPS-based time at the charge control station 14 reaches the first detonation time. Similarly, the charge control station 16 includes a charge control transceiver 54 for communicating with the master station 12 and receiving a second detonation time, a charge control GPS receiver 56 including a GPS antenna 58 for determining a GPS-based time at the charge control station 16, and a detonator 60 for detonating the explosive charge 20 when the GPS-based time at the charge control station 16 reaches the second detonation time. Due to the atomic clocks and the signal structure used by the global positioning system, such GPS-based times and detonation times may be determined to within an accuracy of one microsecond or better regardless of the length of the longest sequential time and the times required in a protocol for communicating between the master station 12 and the charge control stations 14 and 16.

Optionally, the user enters the respective desired locations of the explosive charges 18 and 20 into the master station 12. The charge control GPS receivers 46 and 56 use the GPS signal 40 for determining information for the respective actual locations of the GPS antennas 48 and 58. The location information may be in terms of GPS pseudoranges, or of geographical coordinates such as latitude, longitude, and altitude or x, y, and z. The charge control transceivers 14 and 16 transmit the location information to the master station 12. The master station 12 then uses reverse differential GPS techniques for computing differentially corrected GPS (DGPS) locations for the explosive charges 18 and 20. Accuracies of such DGPS locations may be one-half meter or better. For achieving such accuracies, it is important that the physical distance between the GPS antennas 48 and 58 and the explosive charges 18 and 20, respectively, be very small compared to the desired DGPS accuracy or have an accurately known position offset. Where a known offset is used, the master station 12 is programmed to consider the offset in calculating the DGPS locations of the explosive charges 18 and 20. The master station 12 then compares the DGPS locations to the desired locations and issues a warning to a user when the actual locations differ from the desired locations by more than a user selected threshold distance.

In another option, the charge control GPS receivers 46 and 56 use the GPS signal 40 for determining GPS phase observable location information for the respective GPS antennas 48 and 58. The charge control transceivers 14 and 16 transmit the GPS phase observable information to the master station 12. The master station 12 then uses the GPS phase observables for respective GPS antennas 48 and 58 for a precise determination of their positions. Accuracies of such phase-based precise position may be as good as one centimeter or even better. The precise positions of the GPS antennas 48 and 58 may then be compared to the desired locations for the explosive charges 18 and 20, respectively, as described above. Further, such precise positions may be used for refining the sequential times in consideration of the precise positions where the explosive charges 18 and 20 are actually located in order to obtain the best possible blast shape without relocating the explosive charges 18 and 20 or when it is impractical to locate the explosive charges 18 and 20 in the desired locations. For such precise positioning it is important that the phase centers of the GPS antennas 48 and 58 be located as close as possible or with a known position offset from the respective explosive charges 18 and 20. GPS receivers for such DGPS and precise positioning techniques are commercially available from Trimble Navigation Limited of Sunnyvale, California.

Figure 2:
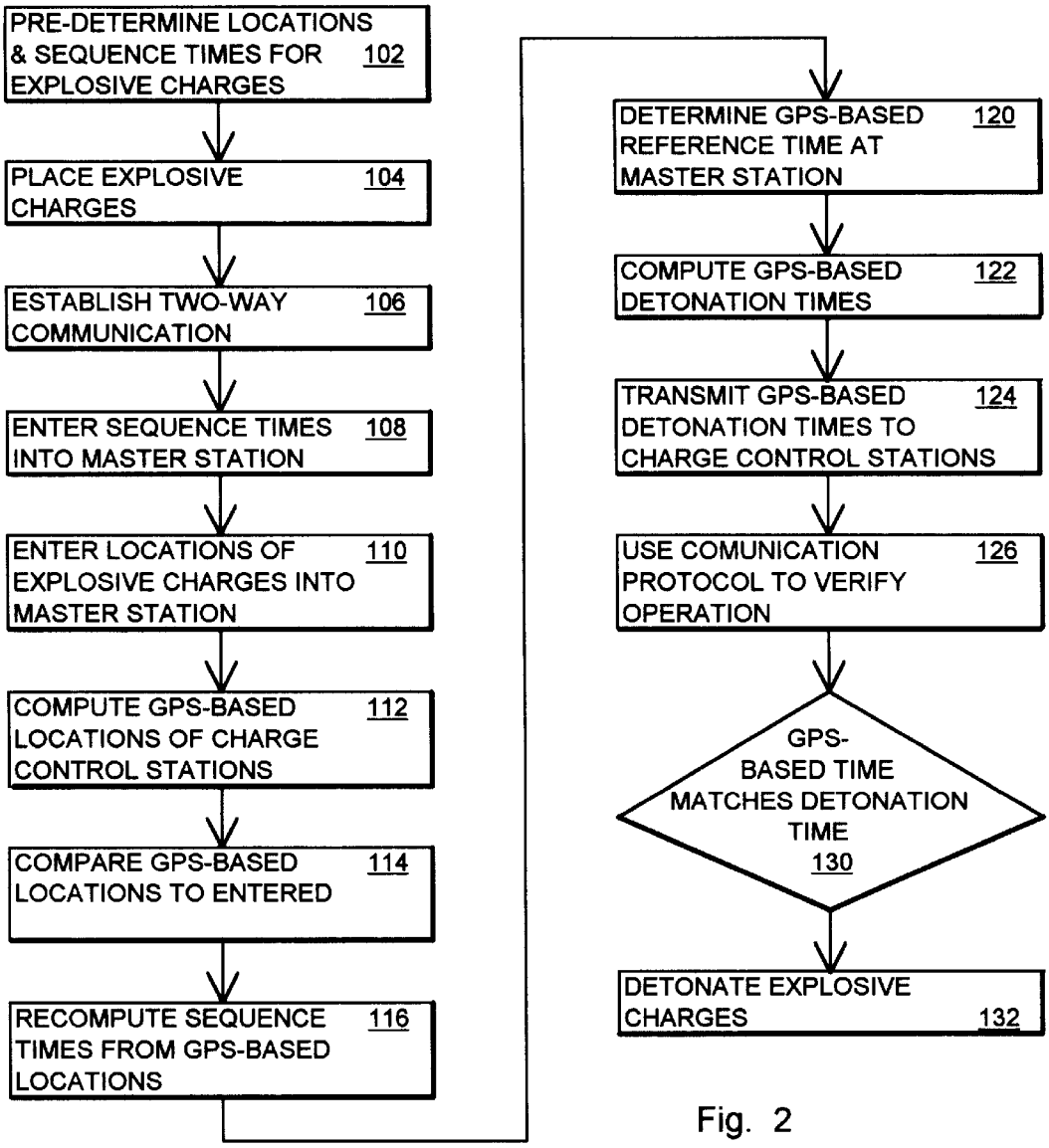
FIG. 2 is a flow chart of the operation of the blasting system of FIG. 1.

FIG. 2 is a flow chart of the operation of the blasting system 10 for creating a shaped charge. In a step 102, the number of charge control stations 14 and 16 and respective explosive charges 18 and 20; the quantity of explosives in the explosive charges 18 and 20; the relative locations of the explosive charges 18 and 20 with respect to each other and with respect to the physical material to be impacted by the blast; and the sequence times for detonating the explosive charges 18 and 20 are pre-determined in order to properly shape the blast. In a step 104 the explosive charges 18 and 20 and the associated charge control stations 14 and 16 are placed according to the pre-determined locations. In a step 106 the master station 12 establishes two-way communication with all of the charge control stations 14 and 16. The master station 12 uses the two-way communication for confirming that the charge control stations 14 and 16 are operating correctly. Preferably, the status check confirms that a self-test has been passed, the battery charge level is sufficient, and the communication signal and the GPS signal 40 are being received at sufficient signal-to noise ratios. If communication cannot be established with all of the charge control stations 14 and 16, or if the correct operation is not confirmed, the blast is discontinued.

In a step 108, a user enters the respective sequence times for each one of the explosive charges 18 and 20 and then enters a blast time for a time in the future for triggering the blast. The blast time may be in terms of an absolute time such as 13 hours, 00 minutes and 00 seconds or an incremental time such as is 02 minutes and 00 seconds from now.

An optional sequence of steps 110, 112, 114, and 116 enable a user to verify that the explosive charges 18 and 20 are correctly placed. In the step 110 the user inputs the predetermined locations of the explosive charges 18 and 20 into the master station 12. In a step 112 the charge control stations 14 and 16 determine and transmit location information for their actual locations to the master station 12. In a step 114 the master station 12 compares the actual locations of the explosive charges 18 and 20 to the locations that were entered and issues a warning to the user when the actual and desired locations differ to more than a selected distance threshold. In a step 116 under control of the user, the master station 12 recomputes the sequence times in consideration of the actual locations of the explosive charges 18 and 20.

In a step 120 the master station 12 determines a reference time from the GPS-based time approximately corresponding to the user entered blast time. In a step 122 the master station 12 computes the detonation times from the reference time and the sequential times. In a step 124 the master station 12 transmits a master control signal including the detonation times to the charge control stations 14 and 16. Alternatively, the master station 12 may transmit the reference time and the sequence times separately and the detonation time may be computed at the charge control stations 14 and 16. In a step 126 the charge control stations 14 and 16 acknowledge their operation status and receipt of the respective detonation times. A protocol using two-way communication continues until it is assured that all of the charge controllers 14 and 16 are operational and have received their respective detonation times. Otherwise, the protocol causes the operation to be aborted.

In a step 130 the charge control stations 14 and 16 compare the GPS-based time to their respective detonation times. Then, at a step 132 when the GPS-based time reaches the detonation time, the charge control station 14 and 16 detonate the respective explosive charges 18 and 20.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A global positioning system (GPS) blasting system, comprising:

a charge control communication receiver for receiving a master control signal having a detonation time;

a charge control GPS receiver for tracking GPS-based time; and a detonator coupled to the charge control communication receiver and the GPS receiver for issuing a detonation command for detonation of an explosive charge when said GPS-based time reaches said detonation time.

2. The blasting system of claim 1, further comprising:

a master station including a master GPS receiver for determining said GPS-based time and using said GPS-based time for computing said detonation time, and a master communication transmitter for transmitting said master control signal.

3. The blasting system of claim 1, wherein:

the charge control GPS receiver is further for determining GPS-based charge location information indicative of an actual location of said explosive charge; and further comprising:

a charge control communication transmitter for transmitting a charge control signal having said charge control location information; and a master station including a master communication receiver for receiving said charge control signal, for receiving a user entered location for said explosive charge, and for determining where said actual location differs from said user entered location by more than a selected distance.

4. The blasting system of claim 1, wherein:

the charge control GPS receiver is further for determining GPS-based charge location information indicative of an actual location of said explosive charge; and further comprising:

a charge control communication transmitter for transmitting a charge control signal having said charge control location information; and a master station including a master communication receiver for receiving said charge control signal and a master GPS receiver coupled to the master communication receiver for using said charge control location information for computing said detonation time.

5. The blasting system of claim 1, further comprising:

a second charge control communication receiver for receiving said master control signal having a second detonation time;

a second charge control GPS receiver for tracking said GPS-based time; and a second detonator coupled to the second charge control communication receiver and the second GPS receiver for issuing a second detonation command for detonation of a second explosive charge when said GPS-based time reaches said second detonation time.

6. The blasting system of claim 5, wherein said detonation time includes a sum of reference time derived from said GPS-based time and a first sequence time and said second detonation time includes a sum of said reference time and a second sequence time.

7. A method for blasting system, comprising steps of:

receiving a master control signal having a detonation time;

tracking GPS-based time with a charge control GPS receiver; and issuing a detonation command for detonation of an explosive charge when said GPS-based time reaches said detonation time.

8. The method of claim 7, further comprising a step of:

determining said GPS-based time with a master GPS receiver;

using said GPS-based time for computing said detonation time; and transmitting said master control signal from a master communication transmitter.

9. The method of claim 7, further comprising steps of:

determining GPS-based charge location information indicative of an actual location of said explosive charge with said charge control GPS receiver;

transmitting a charge control signal having said charge control location information from a charge control communication transmitter;

receiving said charge control signal with a master communication receiver;

receiving a user entered location for said explosive charge;

determining where said actual location differs from said user entered location by more than a selected distance.

10. The method of claim 7, further comprising steps of:

determining GPS-based charge location information indicative of an actual location of said explosive charge with said charge control GPS receiver;

transmitting a charge control signal having said charge control location information from a charge control communication transmitter;

receiving said charge control signal with a master communication receiver; and using said charge control location information for computing said detonation time.

11. The method of claim 7, further comprising steps of:

receiving said master control signal having a second detonation time;

tracking GPS-based time with a second charge control GPS receiver; and issuing a second detonation command for detonation of a second explosive charge when said GPS-based time reaches said second detonation time.

12. The method of claim 11, further comprising steps of:

deriving a reference time from said GPS-based time;

determining said detonation time from a sum of said reference time and a first sequence time; and determining said second detonation time from a sum of said reference time and a second sequence time.

* * * * *